United States Patent [19]

Morard et al.

[11] Patent Number: 4,586,352

[45] Date of Patent: May 6, 1986

[54] RECTILINEAR KNITTING MACHINE

[75] Inventors: Michel Morard, Vouvry; Marcello Baseggio, Ollon, both of Switzerland

[73] Assignee: Atelier de Construction Steiger S.A., Switzerland

[21] Appl. No.: 768,430

[22] Filed: Aug. 22, 1985

[30] Foreign Application Priority Data

Aug. 31, 1984 [EP] European Pat. Off. ..... 84201260

[51] Int. Cl.[4] ..... D04B 7/04

[52] U.S. Cl. ..... 66/64 R

[58] Field of Search ..... 66/64, 60

[56] References Cited

U.S. PATENT DOCUMENTS 2,025,499 12/1935 Diem ..... 66/64

2,312,565 3/1943 Lippitt ..... 66/64

3,304,748 2/1967 Seiler ..... 66/64

*Primary Examiner*—Ronald Feldbaum

*Attorney, Agent, or Firm*—Kane, Dalsimer, Kane, Sullivan and Kurucz

[57] ABSTRACT

Rectilinear knitting machine comprising a frame consisting of two shaped bearing sections, preferably made of bent and soldered sheet steel, extending underneath the needle beds and equipped with vertical standards distributed along the shaped sections and supporting the needle beds with adjustable supports. This constructions enables the length of the needle beds to be increased, while guaranteeing their linearity. In addition, the space between the needle beds is freed for accommodation of rollers and a drawing device.

6 Claims, 2 Drawing Figures

RECTILINEAR KNITTING MACHINE

FIELD OF INVENTION

The present invention relates to a rectilinear knitting machine comprising a frame supporting two needles beds arranged dihedrally above the frame.

PRIOR ART

Numerous machines of this type are known and have been manufactured for several decades. All of these machines have in common a frame with a rigid cast iron section, called the castle, extending like a beam, under and between the needle beds, from one end of the machine to the other. This castle has two oblique faces machined with precision, on which the needle beds rest. This castle does not occupy all the space between the needle beds, but is cut away for passage of the knitted article and accommodation of the drawing device. This castle is intended to hold the needle beds in a perfectly rectilinear position, such that the butts of the jacks of the needles accommodated in the needle bed are activated with precision by the cams of the carriage which travels above the needle beds. However, because of just the castle's own weight, this has a tendency to bend in its central section, that is to say it already has a sag which cannot be ignored when the distance between supports is 1 meter, this effect being amplified by the stresses due to drawing of the knitted goods and the stresses dues to the cams on the needles. This problem has been known for a long time and attempts have been made to solve it by various means. For example, it is known to strap together the feet of the frame to exert a bending moment on the castle in opposition to the bending due to its own weight. In a known machine (ANVH CNC machine from STOLL), tensioning cables have been provided to compensate the sag. Every time the machine is moved, however, it is necessary to make a new adjustment. Moreover, this adjustment is fine and the stresses which it is necessary to exert to compensate the sag are relatively high. This problem has furthermore until now meant a restriction on the length of machines.

SUMMARY OF THE INVENTION

The object of the invention is to solve this problem of sag by providing a frame which is radically different to the traditional concept.

The knitting machine according to the invention is characterized in that the frame comprises two shaped bearing sections extending horizontally parallel to the needle beds, each considerably below the lower edge of each of the needle beds, and on which are fixed vertical standard distributed along the said shaped sections and equipped at their upper end with oblique bearing plates on which the needles beds rest, these bearing plates being equipped with a means of adjustment, allowing adjustment of the support points of the needle beds on the said bearing plates or, respectively, the said screws.

In contrast to the design which has been used for decades and has been accepted as the only valid design, the frame according to the invention does not have a beam between the needle beds, but the bearing section has been divided into two and displaced outside the space demarcated by the needle beds, below the lower end of each of these needle beds, where all the space necessary for effecting rigid support with a sufficient moment of inertia is available. The shaped sections are preferably not solid and consequently relatively light and have only a negligible sag under the effect of their own weight, even over a long length. In addition, the space between the needle beds is free, so that it is easy to accommodate the rollers and other drawing devices. Access to these devices is also greatle facilitated.

The use of tubular beams, supported or realised by bending the sheet metal of the frame, also creates closed tubular spaces along the machine where cables and electrical or mechanical devices can be accommodated.

The most striking result, however, is elimination of the limitation on the length of the machine.

Another advantage which cannot be ignored is the considerable reduction in the cost of production of the frame. This can be produced in bent and soldered sheet metal, that is to say by an inexpensive means which does not require high precision, whereas the production of a cast iron frame and its precise machining constitute very expensive operations.

Finally, the machines are lighter, but without their stability having been affected.

In view of the advantages provided by the embodiment according to the invention, it is surprising that such a design was not adopted a long time ago. This is without any doubt due to the existence of prejudice against an imprecise mode of construction such as the bending and soldering of sheet metal. This imprecision was in contradiction to the precision exacted in machining of the needlee beds and in the maintenance thereof. It was accepted that a sufficient rigidity could only be obtained by means of a solid cast component and that the precision could be obtained only by machining this cast component on precision machine tools.

BRIEF DESCRIPTION OF THE DRAWING

The attached drawing shows, by way of example, an embodiment of the invention.

DESCRIPTION OF THE PREFERRED EMBODIMENTS

Figure 1:
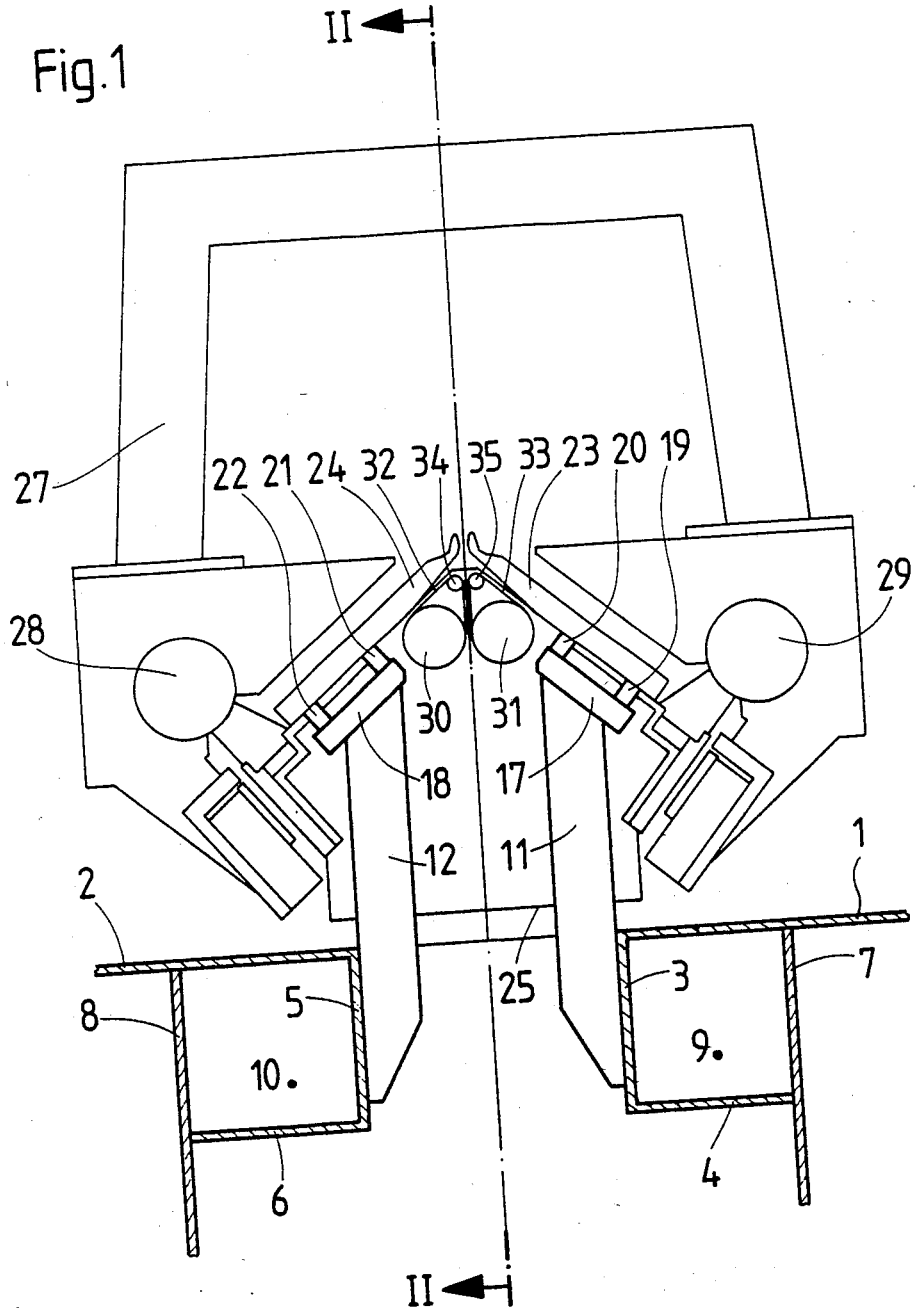
FIG. 1 is a partial view in transverse section along I—I in FIG. 2 of a rectilinear knitting machine, on which the needles beds and cam holder carriage are shown schematically.

The machine shown in the drawing comprises a frame in bent and soldered sheet metal, only the upper and central section of which is shown. This frame comprises exterior sheets of metal 1 and 2 extending on each side parallel to the axis of the machine and bent twice inwards at a right angle to form two walls 3,4 and, respectively, 5,6, the rectangular section thus formed being closed by a vertical sheet of metal 7 and, respectively, 8, these sheets of metal forming with the walls 3 and 4 and, respectively, 5 and 6, two horizontal beams 9 and 10. The sections of the sheets of metal 1,2,7 and 8 not shown of course extend to the ground to form the supporting section of the machine, these sections not having any particular characteristic, except that they are reinforced and braced to ensure the solidity and rigidity of the frame. The beams 9 and 10 can also be braced and cross-braced as required, but whilst preserving a relative lightness. Steel vertical standards such as 11 to 16 are soldered on to each of the beams 9 and 10, the distance between each being about 40 cm and the standards facing each other in pairs such as the vertical standards 11 and 12. The upper ends of these vertical standards are equipped with oblique bearing plates 17 and 18, these bearing plates themselves carrying pairs of supports 19,20 and, respectively, 21 and 22. These supports are equipped with axial screws accessible from the lower face of the bearing plate to enable the height of the supports to be modified. On these supports rest the two needle beds 23 and 24 of the machine, the inclination of which is the same as that of the bearing plates 17 and 18. The needle beds are fixed by each of their ends on the vertical supports 25 and 26 made of steel or cast iron plates. In FIG. 1, the illustration of the machine has been completed by schematic representation of the cam holder carriage 27, which travels on two longitudinal cylindrical rails 28 and 29. A device for continuous drawing, described in detail in Swiss Patent No. 633334, has also been shown between the needle beds. This drawing device comprises two cylinders 30 and 31 driven in rotation and driving in the opposite direction the belts 32 and 33 passing over the low diameter cylinders 34 and 35 situated quite close to the upper end of the needle beds.

Figure 2:
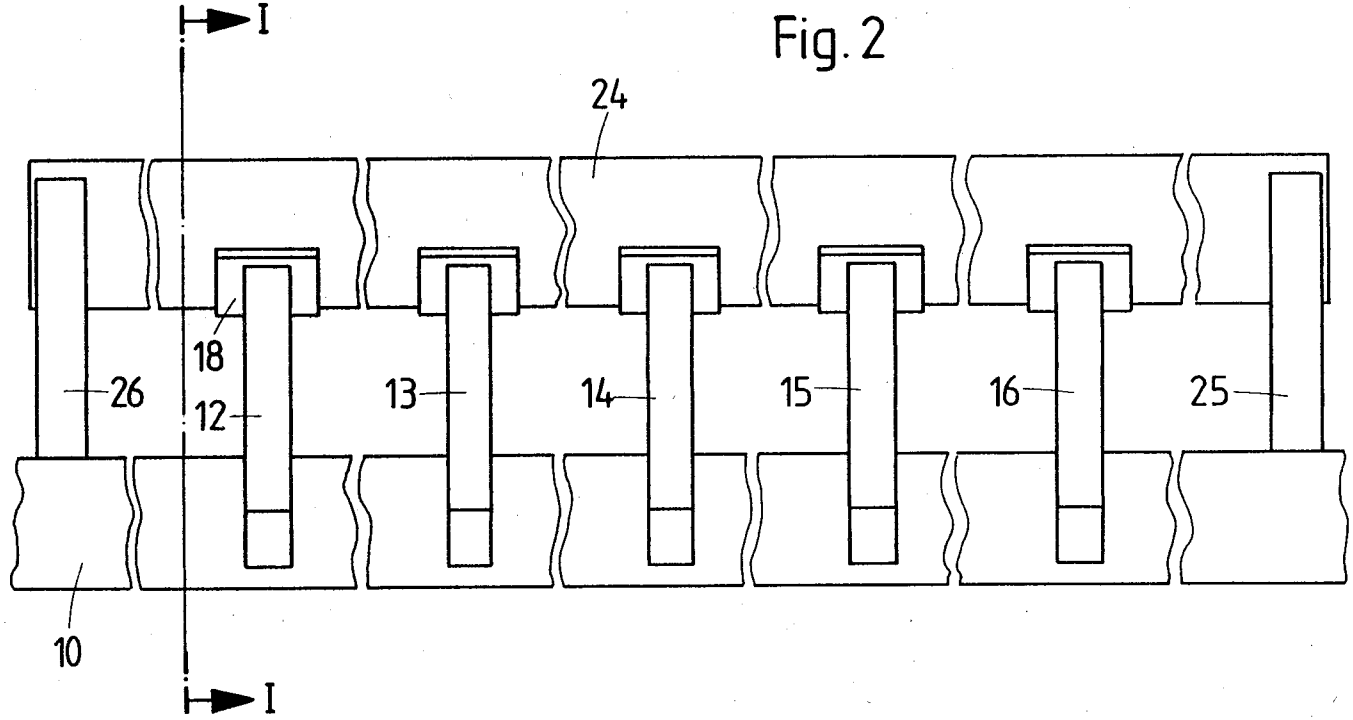
FIG. 2 is a view in axial section along II—II in FIG. 1, without the cam holder carriage.

FIG. 2 shows intentionally a machine of unspecified length, since the construction according to the invention enables precisely a machine of any desired length to be produced. FIG. 1 clearly shows that the inertia of the support for the needle beds, which up until now was concentrated in the cast iron castle situated between the needle beds, has been displaced to outside the space demarcated by these needle beds. In the zone of the beams 9 and 10, all the space required and necessary to achieve an adequate static moment of inertia, that is to say to realise sufficiently rigid beams, is available. These beams are furthermore relatively light and have very little sag. The vertical standards, such as 11 to 16, exert only relatively little stress on these beams. The height of the vertical standards does not have to be determined with precision, since the differences in height of the support points can be easily compensated by the screws with which the support points are equipped, such as 19 to 22. In addition, no component will encumber the space between the vertical standards of each pair, as has been shown in FIG. 1, allowing easy accommodation of a drawing device such as is shown and also access to this device from underneath the machine.

The beams 9 and 10 could be realised in several other ways using known models of static mechanics.

The beams 9 and 10 can also consist of independent solid, cross-braced or tubular beams. The inside of the beams 9 and 10 can furthermore be used for passage of electrical cables. The vertical supports could be fixed to the beams by means of bolts. The means of adjustment of the support points could be other than transverse screws, for example eccentric gears or shaft keys.

What is claimed is:

1. Rectilinear knitting machine comprising a frame supporting two needle beds arranged dihedrally above the frame, wherein the frame comprises two shaped beam sections extending horizontally parallel to the needle beds, each considerably below the lower edge of each of the needle beds, and on which are fixed vertical standards distributed along the said shaped sections and equipped at their upper ends with oblique bearing plates on which the needles beds rest, these bearing plates being equipped with a means of adjustment, allowing adjustment of the support points of the needle beds on the said bearing plates or, respectively, the said screws.

2. Knitting machine according to claim 1, wherein the frame is at least in part bent and soldered sheet metal and in that the said shaped bearing sections are formed by bending the metal sheets of the frame.

3. Knitting machine according to either of claims 1 and 2, wherein the vertical standards are soldered to the shaped bearing sections.

4. Knitting machine according to either of claims 1 and 2, wherein the vertical standards are fixed by bolts on to the shaped bearing sections.

5. Machine according to claim 1, wherein the said shaped bearing sections consist of steel beams.

6. Knitting machine according to claim 1, wherein the said shaped bearing sections consist of tubular shaped pieces.

* * * * *